United States Patent [19]

Henderson et al.

[11] Patent Number: 4,637,313

[45] Date of Patent: Jan. 20, 1987

[54] EARTH PENETRATOR

[75] Inventors: David Henderson, Carlisle; James A. Hollowell, Groton, both of Mass.; Howard A. Woodbury, Plaistow, N.H.

[73] Assignee: Avco Corporation, Wilmington, Mass.

[21] Appl. No.: 702,410

[22] Filed: Dec. 31, 1984

Related U.S. Application Data

[63] Continuation of Ser. No. 226,663, Jan. 5, 1981, abandoned.

[51] Int. Cl.[4] ..... F42B 25/20

[52] U.S. Cl. ..... 102/398; 102/293; 102/382

[58] Field of Search ..... 244/3.24, 3.26, 3.1; 102/348, 382, 385, 398, 400, 473, 479, 501, 293

[56] References Cited

U.S. PATENT DOCUMENTS

| | | | |
|---|---|---|---|
| 536,565 | 3/1895 | Crowley | 102/479 |
| 1,742,836 | 1/1930 | Van Essen | 102/473 |
| 1,874,951 | 8/1932 | Foulon | 244/3.24 |
| 2,992,794 | 7/1961 | Boyd | 244/3.24 |
| 3,113,517 | 12/1963 | Kelley et al. | 244/3.24 |
| 3,262,655 | 7/1966 | Gillespie, Jr. | 244/3.1 |
| 3,765,335 | 10/1973 | Blair et al. | 102/400 |
| 3,774,540 | 11/1973 | Burford et al. | 102/382 |
| 3,861,314 | 1/1975 | Barr | 102/501 |
| 4,153,223 | 5/1979 | Romer et al. | 244/3.24 |
| 4,334,657 | 6/1982 | Mattson | 102/473 |

FOREIGN PATENT DOCUMENTS

| | | | |
|---|---|---|---|
| 2639445 | 3/1978 | Fed. Rep. of Germany | 244/3.24 |

*Primary Examiner*—Charles T. Jordan

*Attorney, Agent, or Firm*—Abraham Ogman

[57] ABSTRACT

A terra-finned earth penetrator having a plurality of axially symmetric fins adapted to rotate in a downward direction in response to off-axis inertial reactive forces generated on impact with earth. The penetrator thereby executes a tuck maneuver within the earth surface thereby avoiding ricochet, broaching or upward turning found in low level weapon delivery systems.

7 Claims, 7 Drawing Figures

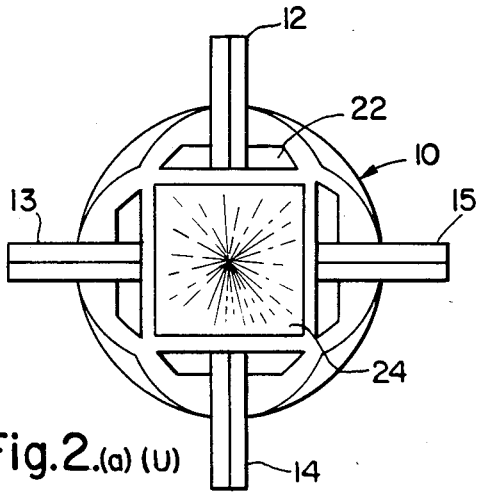
Fig.2.(a) (U)
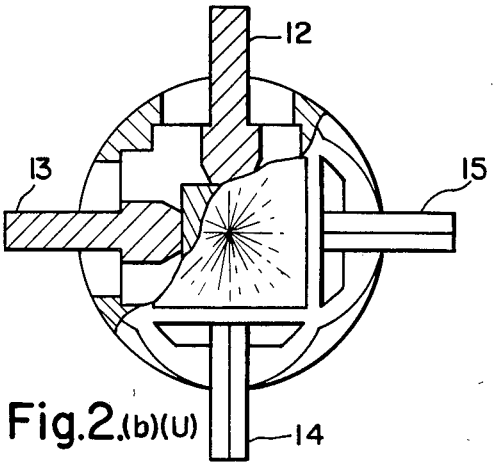
Fig.2.(b)(U)
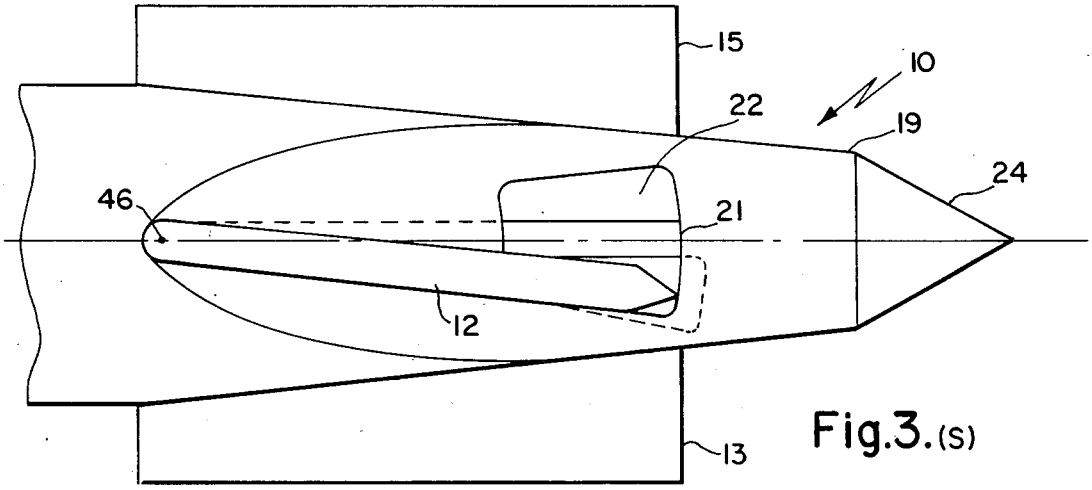
Fig.3.(S)
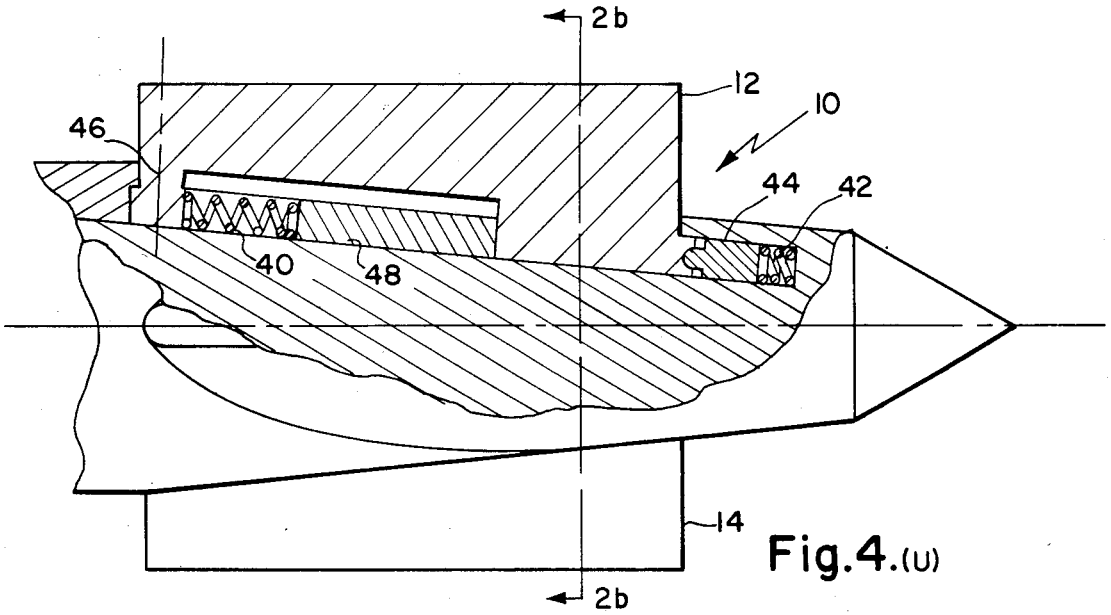
Fig.4.(U)

EARTH PENETRATOR

This is a continuation of application Ser. No. 226,663, filed Jan. 5, 1981, now abandoned.

DESCRIPTION

1. Technical Field

The technical field is apparatus for controlling penetration of a projectile and in particular low level delivery projectiles.

2. Background Art

In order to avoid detection and application of countermeasures, it is desirable to fly or deliver projectiles, such as missiles, at low levels of attack. Terrain-following missiles which are guided along the contours of the earth's surface are typical of the type of projectiles which attack at low levels.

Certain targets for such missiles may be located beneath the earth's surface. A missile approaching such a target from a low level impacts at a relatively small angle (called graze angle) with respect to the horizontal earth plane as compared, for example, to the trajectory of an intercontinental ballistic missile which enters substantially straight down, at a 90° angle to the earth's plane.

Small graze angles degrade penetration performance by inducing ricocheting instead of penetration or broaching (where the projectile enters the surface and then exits out the surface) or at the very least, upward turning of the projectile. The graze angle affects the performance requirements of the penetrator in accordance with the formula d/sin $\gamma_g$ where "d" is the depth of the target and $\gamma_g$ is the graze angle.

In other words, for a given buried target, the smaller the graze angle, the further the projectile has to travel through the earth to intersect the target. This means that the projectile has to impact at greater velocity, and be able to withstand the increased impact environment.

One solution to this problem is to provide logic in the missile which would direct the missile to climb just before impact and then enter into a steep dive approach at the target. This solution, which requires the missile to fly at higher altitudes, renders the missile susceptible to detection and countermeasures during the critical period of attack.

The prior art is replete with solutions to the problem of preventing projectiles from penetrating too far in the earth, such as, U.S. Pat. No. 3,765,335 in which a metal tube is cut so as to spread on impact to prevent deep penetration if a target such as soft dirt is struck and U.S. Pat. No. 3,774,540 which provides a terradynamic brake for an air dropped projectile consisting of a tube with a series of vertical slotted sections which bend at right angles on impact.

None of these prior art patents are addressed to the problem of enhancing penetration under graze impact conditions. Consequently, a need exists for a simple, inexpensive method and apparatus to enable earth penetration of projectiles approaching buried targets at low graze angles.

INVENTION DISCLOSURE

The solution to this problem as proposed in the present invention is to provide the penetrator with the capability of executing a maneuver in the ground similar to the "downward tuck" maneuver a diver executes when entering the water.

The penetrator is provided with hinged fins which rotate in response to off-axis forces generated on impact with the earth's surface. These fins interact with the ground/surface media and hence are called terra-fins. As will be explained in detail, the angle of attack of the terra-fins with respect to the ground/surface media induces rotation of the penetrator into the target media whereby the penetrator gradually is induced to penetrate on a vertical path through the earth instead of ricocheting, broaching or turning upward.

BRIEF DESCRIPTION OF THE DRAWINGS

FIG. 2(*a*) is an end view of the penetrator.

FIG. 2(*b*) is a partially exploded end view of the penetrator.

FIG. 3 is a top view of the nose cone end of the penetrator with one fin rotated.

FIG. 4 is a partially exploded side view of the nose cone end of the penetrator.

BEST MODE FOR CARRYING OUT THE INVENTION

Figure 1:
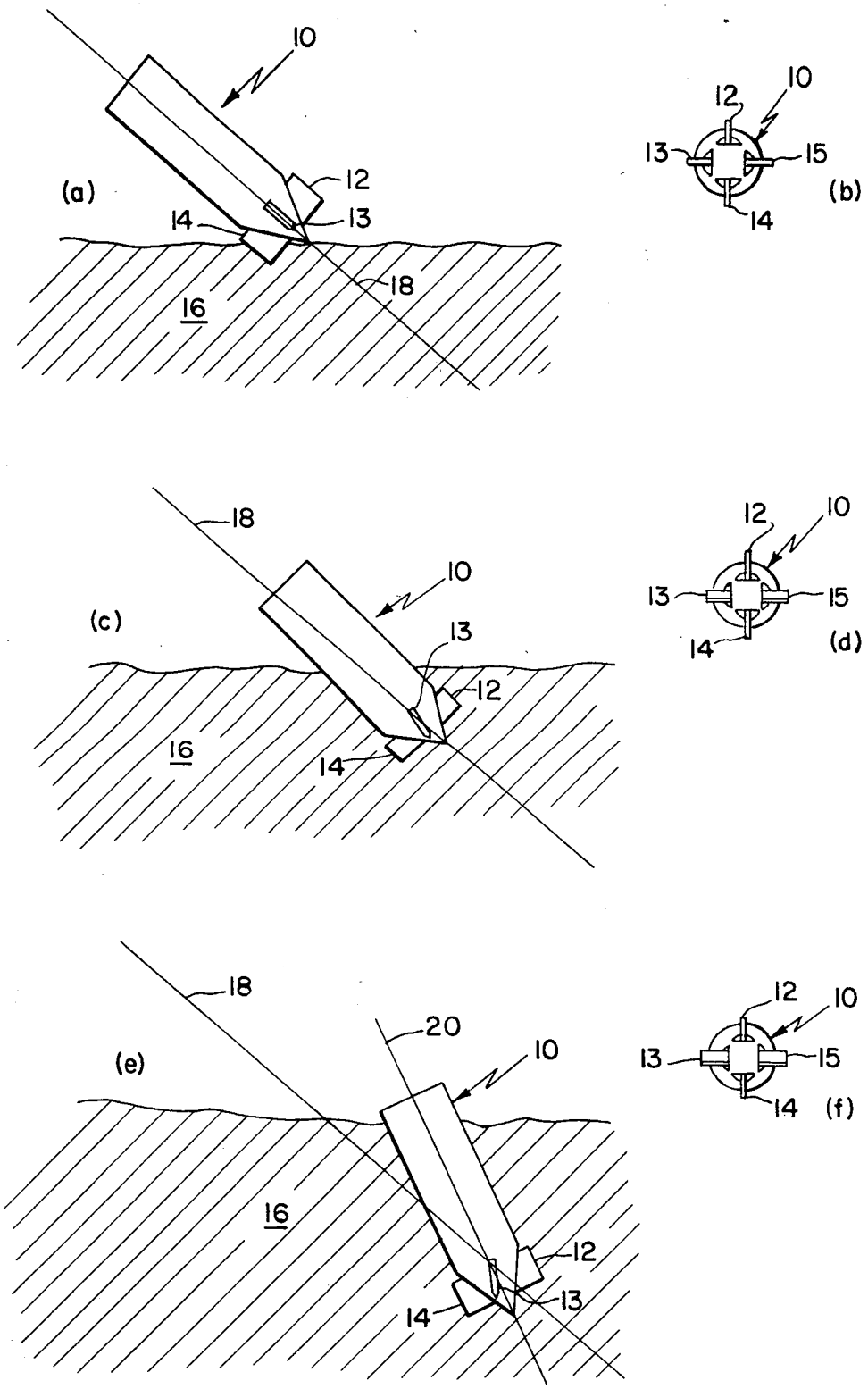
FIG. 1(*a–f*) is a diagrammatic illustration of the physical events which occur when a penetrator in accordance with the invention executes a tuck maneuver.

Referring now to FIG. 1, there is shown a penetrator 10 which may be a missile having a guidance section, a warhead section and a rocket rotor section, which are well-known and are not shown since they are not material to this invention. Penetrator 10 is provided with four hinged terra-fins 12, 13, 14 and 15, preferably located at the nose or forward end of the missile and hence are called "canard" type terra-fins. It should be understood, however, that these fins may be located at either end or in the middle section of the missile.

The fins are hinged from the aft end. Prior to impact the fins are symmetrically disposed in orthogonal planes as shown in FIG. 1(*b*). Upon impact the forward edge of any fin subjected to off-axis impact forces will swing downward in inertial reaction to the impact of the penetrator with the ground/surface media 16 as shown in FIGS. 1(*c*) and (*d*).

In other words, the hinged terra-fins induce a negative angle of attack on the penetrator upon impact with the surface media. Thus, instead of penetrating along the line 18 of FIG. 1(*a*) or being rotated upward as the penetrator tries to follow the path of least resistance, the penetrator is caused to rotate as shown in FIG. 1(*e*) to an equilibrium angle of attack along the line 20; thereby executing a "downward tuck" maneuver.

The details of the hinged terra-fin construction are depicted in FIGS. 2–4. The penetrator 10 has an external cylindrical body 19 which tapers to a nose cone 24 at the forward portion. Four hinged terra-fins 12, 13, 14 and 15 are pivotally mounted on the penetrator body so that, when the penetrator is subjected to lateral impact loads, the fins will rotate to a trim position (as shown in FIG. 3 with respect to fin 12). The fins are positioned so the penetrator is induced to execute a tuck maneuver.

The fins extend through slots 22 provided in the outer body of penetrator 10.

The fins are pivotally mounted at the aft end on journal and bearing members (not shown) so that they may pivot about a pivot axis 46 (in the case of fin 12). During flight, the fins are maintained in a "locked" position [as shown in FIGS. 2(*a*) and 2(*b*)] by fore and aft detent mechanisms 44 and 48 which interlock with flange 21 affixed to the forward end of the fins.

Prior to impact, each fin is locked in the position shown in FIG. 2 with fins 12 and 14 aligned in the same plane and fins 13 and 15 aligned in a plane perpendicular thereto. It is assumed that the penetrator will not be provided with roll control or gravity sensing capability. Therefore, the penetrator must be capable of executing a tuck maneuver regardless of the roll orientation of the penetrator.

This is accomplished automatically by the release of the plunger lock 48 in response to inertial reactive "off" axis forces on impact. Each fin subjected to such forces is then unlocked and free to rotate in response to this impact. Once free, of necessity, the fin will rotate in a direction opposite to the direction of the reaction vector, that is, towards the earth.

Figure 5:
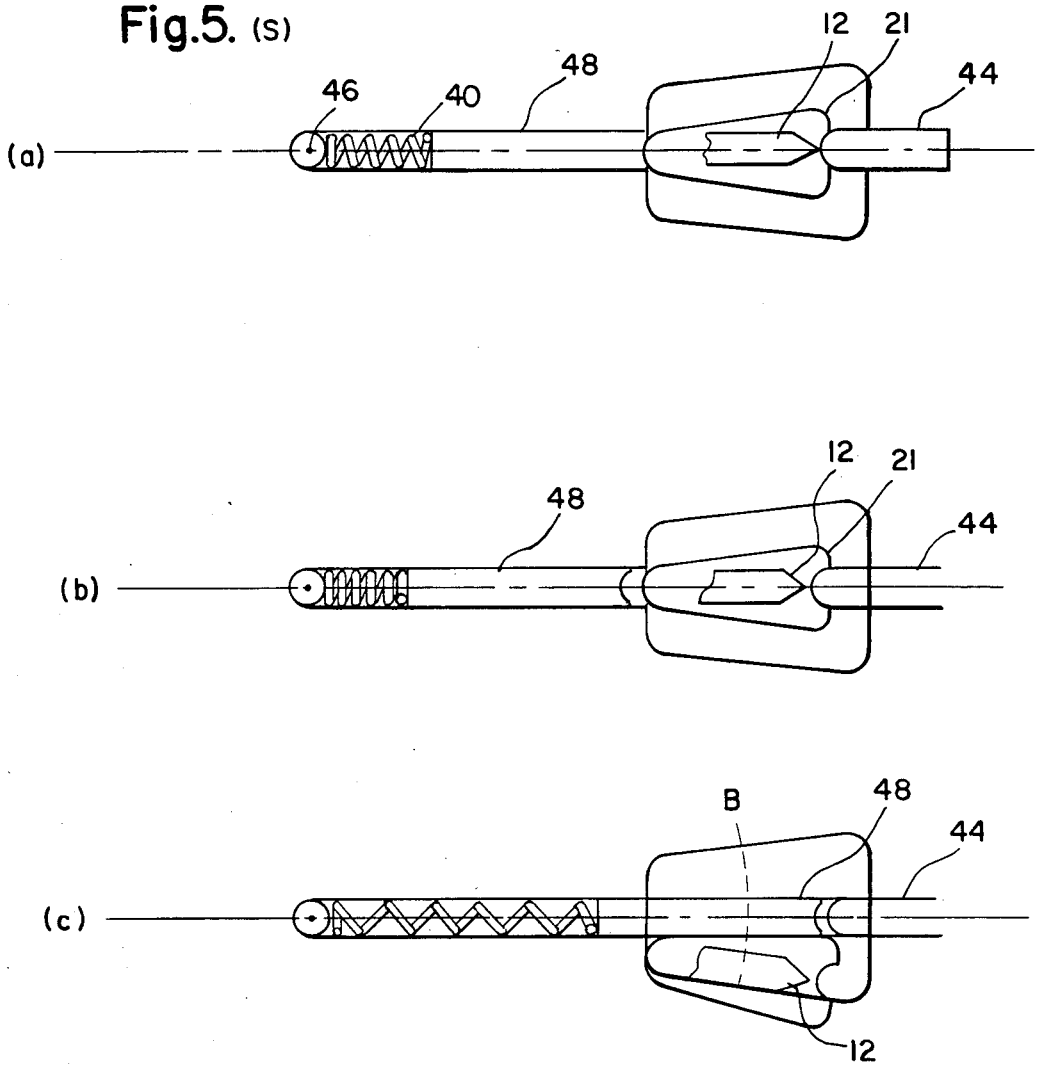
FIG. 5(*a–c*) is a diagrammatic illustration of a mechanism for enabling a hinged fin to pivot on impact.

FIG. 5 illustrates the latching mechanism which maintains the fins latched until subjected to non-axial forces. A fin, such as fin 12, is pivotally mounted about pivot point 46 in a horizontal plane parallel to line 52. A spring 40 exerts a force in the direction to maintain plunger 48, contained in a guide rail on body 10, locked against a curved portion of the flange 21 located at the trailing edge of fin 12. A forward spring loaded latch 44 responsive to gravitational forces interlocks with the front portion of flange 21 located at the leading edge of fin 12.

During boosted flight, the plunger lock 48 is likely to retract; however, the forward "g" latch 44 retains the fin in an axis symmetric position. Upon high obliquity impact, the forward "g" latch 44, which may simply comprise a spring-loaded movable mass, retracts due to axial deceleration [shown by the arrow C in FIG. 5(*b*)] while the off-axis inertial reactive force causes the plunger lock 48 to release the flange of the fin in the desired direction so that the fin pivots as shown by the arrow B in FIG. 5(*c*).

Once the fin 12 is released, the plunger lock 48 moves forward along the guide rail and latches or locks the fin in the extreme downward position shown in FIG. 5(*c*).

The terra-fins are preferably made of suitable high-strength material to structurally survive the terrady-namic loading environments associated with typical earthen targets. Upon impact with intermediate hard targets, such as intermediate concrete or similar reinforced surfaces, the fins are designed to shear off. For the buried target, these terra-fins would shear off during penetration of the hardened portion of the target; not, however, before the terra-fins had initiated the tuck maneuver. Thus, during transit between the surface and the hardened portion, the terra-fins would have:

1. Caused the penetrator to tuck downward;
2. Generated a negative angle of attack; and
3. Generated a downward pitch rate, all of which significantly enhances perforation of a hardened target.

The apparatus of the invention also is quite effective against a variety of targets, for example, runways or bunkeretts. Runways will cause terra-fin stripping upon impact with the hard surface. Due to the graze impact obliquities, the penetrator will flow an upward or natural tuning trajectory caused by natural surface effects bringing the penetrator in close proximity with the surface for an effective cratering charge. Bunkeretts will also be effective targets. No tuck maneuver will be induced due to the symmetric lateral (off-axis) loading on impact. As previously stated, the terra-fins will not rotate to a trim position without lateral impact loads and are locked in place in the absence of immediately applied lateral loads.

Figure 6:
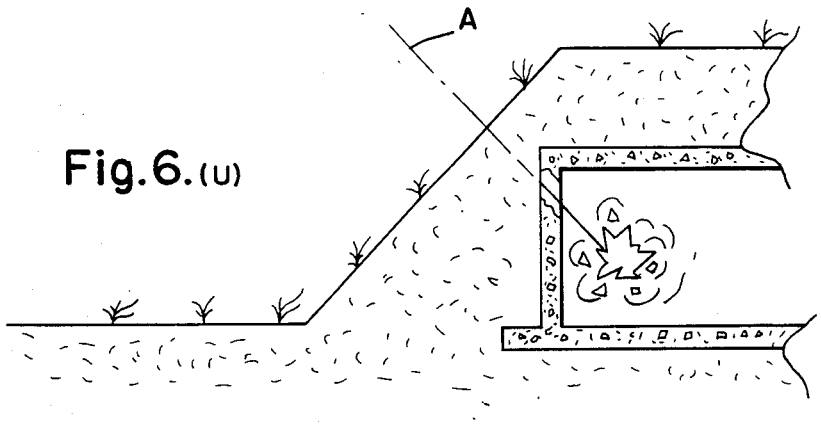
FIG. 6 is a diagrammatic illustration of a trajectory of a penetrator through sand or earth overburden.

The terra-fin is designed to withstand the forces induced by a sand or earth overburden; once the penetrator strikes a hard surface such as a concrete barricade, runway or roadway, the terra-fins strip off allowing the penetrator to follow a natural trajectory through the target media. Thus, in a buried bunkerett media, the penetrator will follow the course prescribed by arrow A in FIG. 6.

Those skilled in the art will recognize many equivalents to the specific embodiments described herein. Such equivalents are considered part of this invention and are intended to be covered by the following claims.

We claim:

1. A penetrator comprising:

(a) a tubular body;

(b) symmetric fins extending radially from the axial center of rotation of said body;

(c) said fins being adapted in response to non-axially inertial forces to rotate in a plane about a pivot axis which intersects the center of rotation of roll axis of said body whereby upon impact of said body with an object, any fins subjected to non-axially inertial forces will rotate in a direction opposite to such forces.

2. The apparatus of claim 1 in which the fins are maintained symmetrical until impact.

3. The apparatus of claim 1 in which the fins are mounted on the forward section of the body.

4. The apparatus of claim 3 in which the fins comprise two pairs of fins mounted in planes perpendicular to each other.

5. The apparatus of claim 4 in which the fins are disposed in a plot between two spring loaded members which are responsive to axial directed forces to either maintain the fins locked or which release the fins in response to non-axial forces.

6. The apparatus of claim 5 in which the fins shear off when subjected to forces in excess of a predetermined amount.

7. A method for penetrating the earth to reach targets buried under the earth comprising the steps of:

(a) pivotally mounting at least a pair of fins on a missile body in symmetry with respect to the axial center of rotation of said body, the pivot axis of said fins intersecting said missile body axis of rotation;

(b) interlocking said fins fore and aft by spring loaded mechanisms;

(c) releasing any such fin which is subjected to non-axial exerted inertial forces such that such fin will rotate in a direction opposite to such force.

* * * * *